US006746060B2

(12) United States Patent
O'Brien, II

(10) Patent No.: US 6,746,060 B2
(45) Date of Patent: Jun. 8, 2004

(54) TUBULAR LATCH ASSEMBLY FOR EXIT DEVICES AND LOCKS

(75) Inventor: James A. O'Brien, II, LaSalle, MI (US)

(73) Assignee: Ervos, Inc., Pittsburgh, PA (US)

( * ) Notice: Subject to any disclaimer, the term of this patent is extended or adjusted under 35 U.S.C. 154(b) by 57 days.

(21) Appl. No.: 09/841,281

(22) Filed: Apr. 24, 2001

(65) Prior Publication Data

US 2001/0035655 A1 Nov. 1, 2001

Related U.S. Application Data

(60) Provisional application No. 60/200,833, filed on Apr. 28, 2000.

(51) Int. Cl.[7] ..... E05B 9/00

(52) U.S. Cl. ..... 292/337; 292/92; 292/DIG. 51; 292/DIG. 57

(58) Field of Search ..... 292/337, DIG. 51, 292/DIG. 57, 92, 93

(56) References Cited

U.S. PATENT DOCUMENTS

| | | | | | |
|---|---|---|---|---|---|
| 57,423 | A | | 8/1866 | Wood | |
| 390,409 | A | * | 10/1888 | Spengler | |
| 958,353 | A | * | 5/1910 | Arens | |
| 1,756,667 | A | | 4/1930 | Soemer | |
| 2,349,301 | A | * | 5/1944 | Overby | 292/2 |
| 3,036,850 | A | * | 5/1962 | Schmid | |
| 3,322,451 | A | * | 5/1967 | Bredemus | 292/137 |
| 3,696,648 | A | | 10/1972 | Horgan, Jr. | |
| 3,937,504 | A | * | 2/1976 | McElroy | 292/164 |
| 3,948,550 | A | * | 4/1976 | Vigluicci | 292/137 |
| 4,418,949 | A | | 12/1983 | Horgan, Jr. | |
| 4,623,175 | A | * | 11/1986 | Carroll | 292/40 |
| 4,664,433 | A | * | 5/1987 | Solovieff | 292/337 |
| 4,691,948 | A | * | 9/1987 | Austin | 292/171 |
| 4,711,478 | A | * | 12/1987 | Carroll | 292/173 |
| 5,058,940 | A | * | 10/1991 | Hart | 292/167 |
| 5,062,671 | A | * | 11/1991 | Goetz | 292/175 |
| 5,100,184 | A | * | 3/1992 | Schmitt | 292/144 |
| 5,358,291 | A | * | 10/1994 | Malmanger | 292/175 |
| 5,486,026 | A | * | 1/1996 | Borgardt | 292/71 |
| 5,947,534 | A | | 9/1999 | Zarzycki, Jr. | |
| 6,045,169 | A | * | 4/2000 | Frolov | 292/332 |
| 6,312,026 | B1 | * | 11/2001 | Workman | 292/252 |
| 6,318,138 | B1 | * | 11/2001 | Mathews | 70/278.7 |
| 6,327,881 | B1 | * | 12/2001 | Grundler | 70/107 |
| 6,361,087 | B1 | * | 3/2002 | Collet | 292/140 |
| 6,393,878 | B1 | * | 5/2002 | Fayngersh | 70/107 |

* cited by examiner

*Primary Examiner*—Gary Estremsky
(74) *Attorney, Agent, or Firm*—Paul A. Beck and Associates

(57) ABSTRACT

A bored-in latch assembly for an exit device having a latch tube which extends past the face plate and past at least a leading edge of the scalp where the leading edge of the scalp is adjacent to the face plate, thereby providing a bearing surface for the latchbolt within the latch tube and in which the bearing surface is free of any edges of the face plate and an edge of the scalp which is adjacent to the face plate.

20 Claims, 5 Drawing Sheets

TUBULAR LATCH ASSEMBLY FOR EXIT DEVICES AND LOCKS

Figure 1:
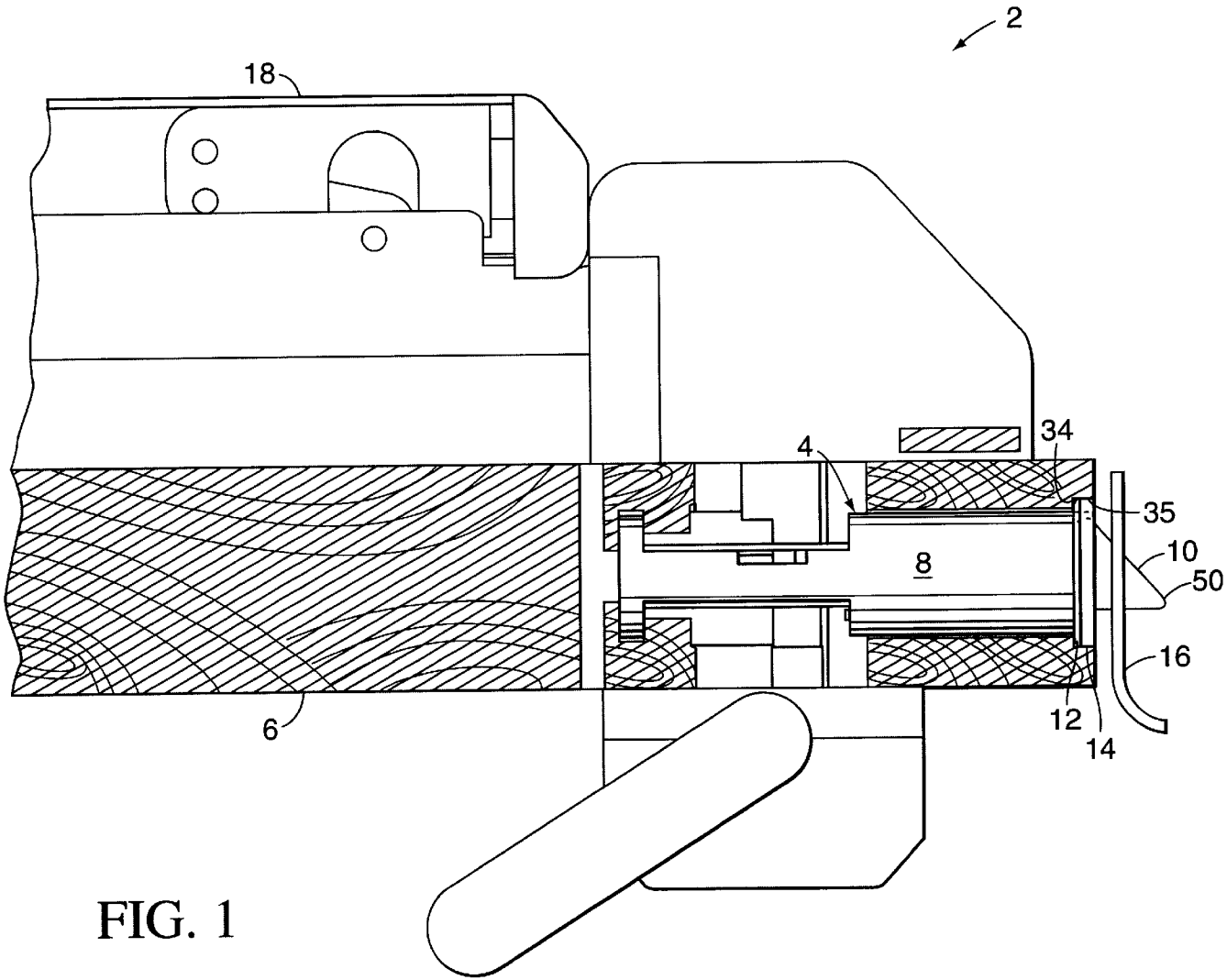

Applicant is claiming the benefit of the prior filed Provisional Application No. 60/200,833 filed on Apr. 28, 2000.

BACKGROUND OF THE INVENTION

1. Field of the Invention

This invention relates to a latch assembly that is used to latch and unlatch a door and more particularly to a bored in latch assembly that fits into a standard #161 door preparation used in connection with an exit device.

2. Description of the Related Art

Exit devices are used in many public places to allow people to exit the premises as quickly as possible. Latch assemblies of existing bored in (cylindrical) locksets and latches will bind when a substantial lateral force is applied in the direction of the door swing. In this type of latch assembly a scalp and a face plate bear the load when a lateral force is applied against the latchbolt as the latchbolt makes a transition from an extended position in a strike to a retracted position in a latch tube. When the latchbolt is in the retracted position it allows the door to open. When lateral force is applied while the latchbolt is extended, edges of the scalp and the face plate actually bite into the side of the latchbolt due to the pressure of the edges of the face plate and the scalp against the flat backside of the latchbolt. This causes the latch bolt to bind and therefore not make the transition to the retracted position and prevents the door from opening. These types of latch assemblies will not withstand the lateral forces required by code, specifically ANSI A1563 tests required for all exit devices.

An example of this type of latch assembly can be seen in U.S. Pat. No. 5,947,534 for Panic Exit Device Suitable for Use with Standard Doors issued Sep. 7, 1999 to Zarzycki. The device in U.S. Pat. No. 5,947,534 provides rollers in the exit device mechanism; however, these rollers are inappropriately placed. Because the rollers are inappropriately placed they are not sufficient to relieve the bind that occurs between the latchbolt and the edges of the face plate and the scalp when under lateral pressure.

There is no known apparatus that effectively reduces the bind that occurs between the latchbolt and the edges of the face plate and the scalp which occurs when substantial lateral force is applied in the direction of the door swing.

The present invention solves this problem by extending the latch tube outward and over the edges of the face plate and the scalp creating a continuous bearing surface that enables smooth retraction of the latchbolt.

SUMMARY OF THE INVENTION

The present invention provides a bored-in latch assembly for an exit device having a latchbolt inserted within a latch tube, the latchbolt engaging a strike, a face plate adjacent to an end of the latch tube, the end is proximate to the strike, a scalp joined to the face place, the latchbolt moves through the latch tube and enters the strike the improvement comprising a latch tube which extends past the face plate and past at least a leading edge of the scalp where the leading edge of the scalp is adjacent to the face plate, thereby providing a bearing surface for the latchbolt within the latch tube and in which the bearing surface is free of any edges of the face plate and an edge of the scalp which is adjacent to the face plate.

The invention additionally provides for a bored in latch assembly that has a separate bearing sleeve between the latch tube and the latchbolt which supports the latchbolt within the latch tube.

The invention also provides for a bored-in latch assembly which includes roller bearings between the latch tube and the latchbolt which supports the latchbolt within the latch tube.

The invention also provides for a bored-in latch assembly in which the latchbolt has a load reduction angle on the swing side of the latchbolt, the angle is more than 90 degrees as determined from an end of the latchbolt which engages the strike, the angle is measured from the end of the latch tube.

A BRIEF DESCRIPTION OF THE DRAWINGS

Figure 2:
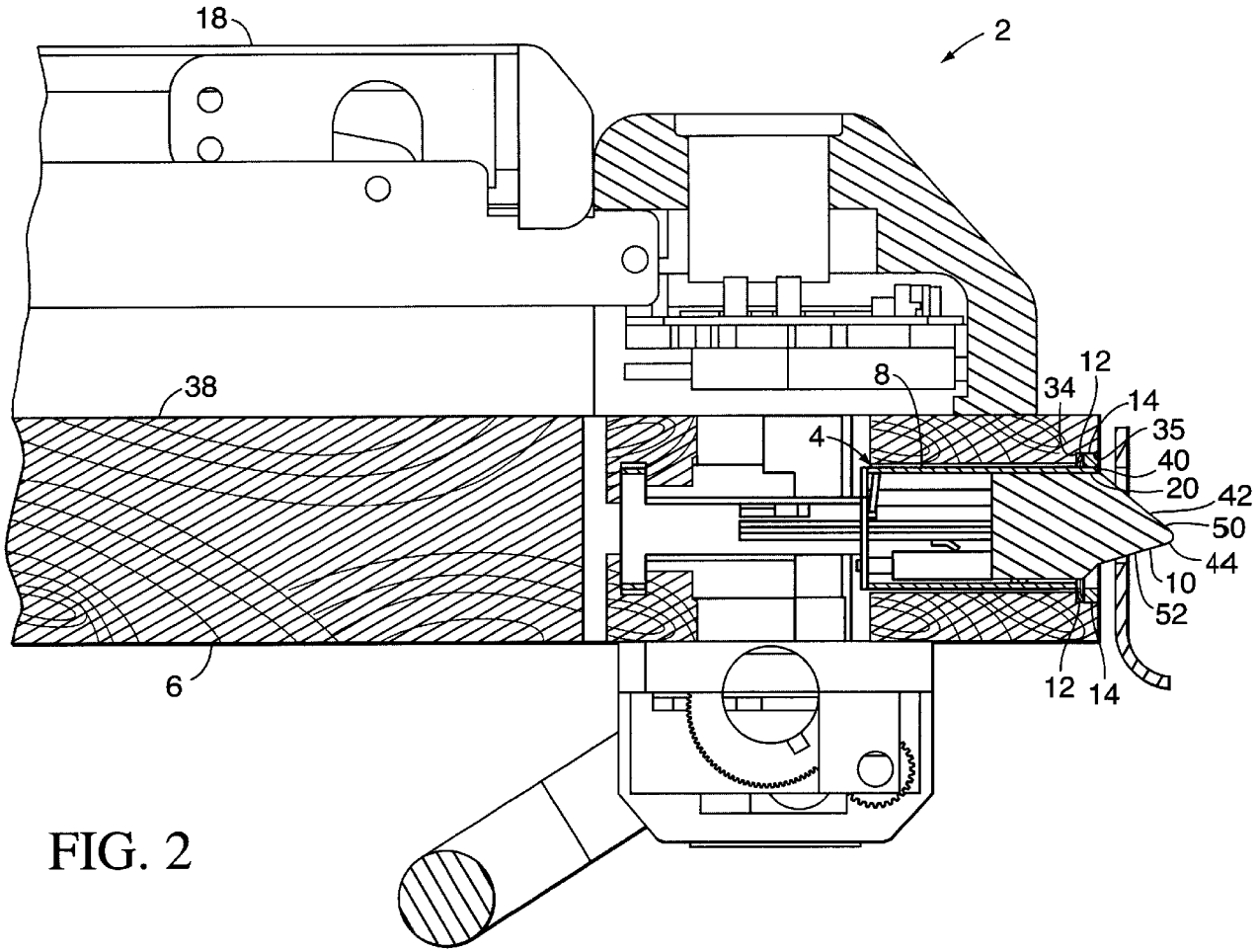
Figure 3:
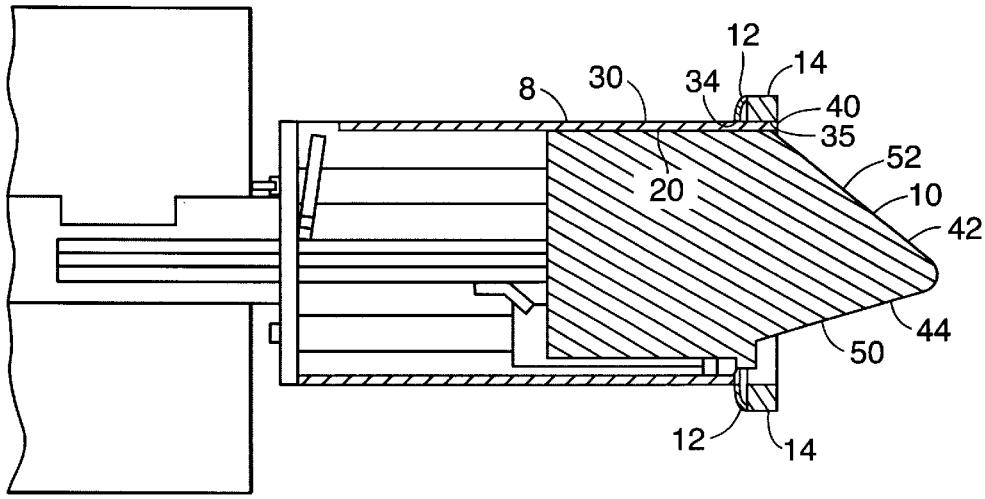
Figure 4:
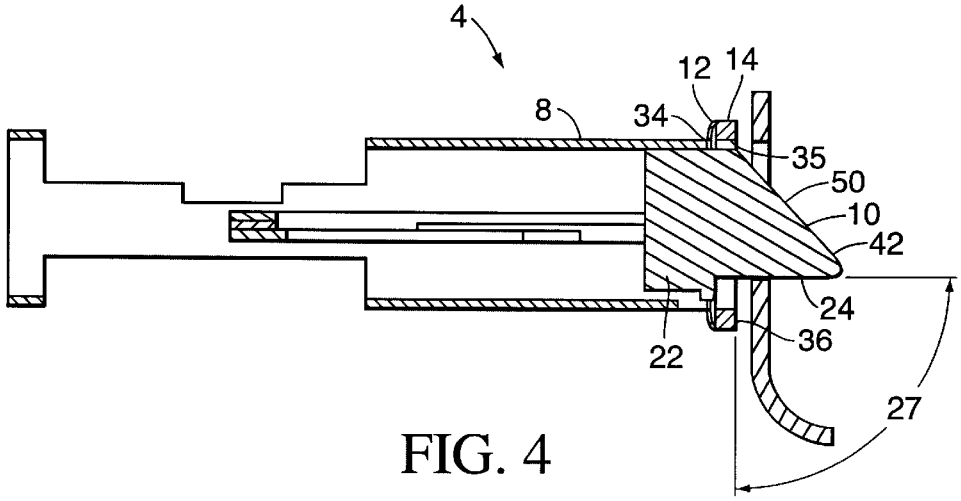
Figure 5:
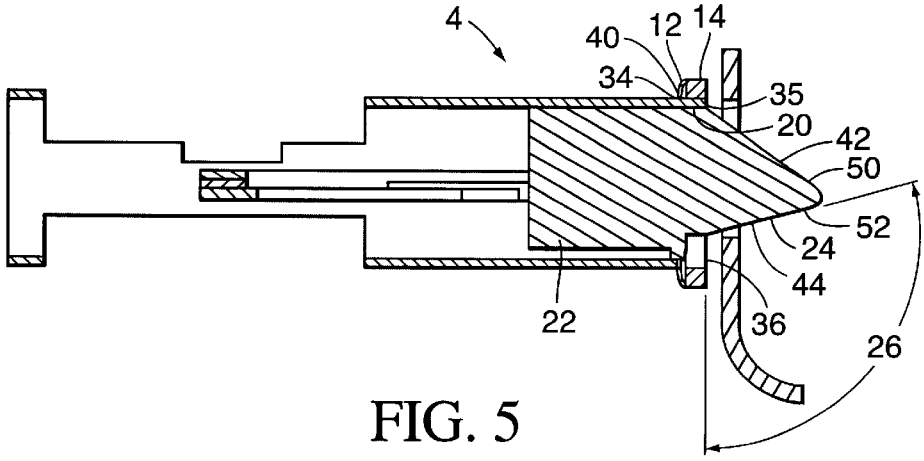
Figure 6:
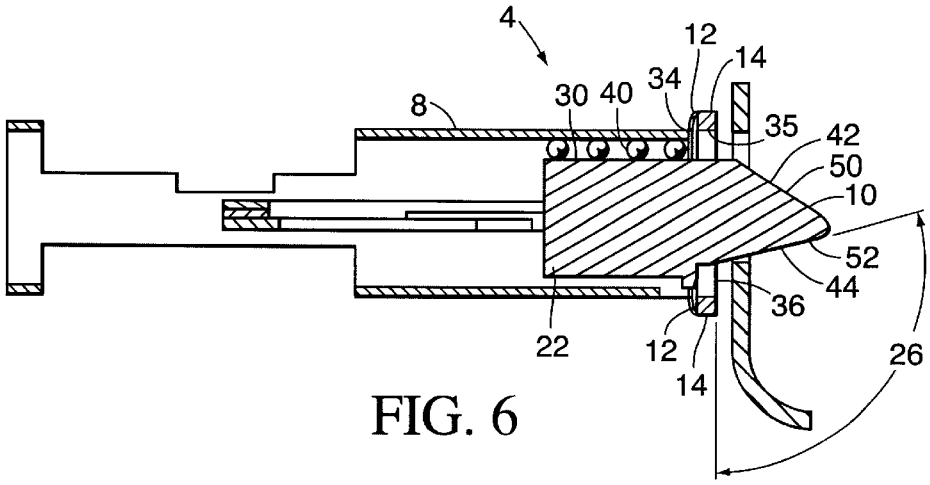

FIG. 1. A top view of a tubular exit device in a door with a standard latch tube assembly;

FIG. 2. A top view of a tubular exit device in a door with the new latch tube assembly;

FIG. 3. A top view of a latch assembly showing a close up of the bearing surface;

FIG. 4. A top view of the standard short latchbolt with single bevel;

FIG. 5. A top view of the elongated latchbolt with double bevel;

FIG. 6. A top view of the elongated latchbolt with roller bearings; and

Figure 7:
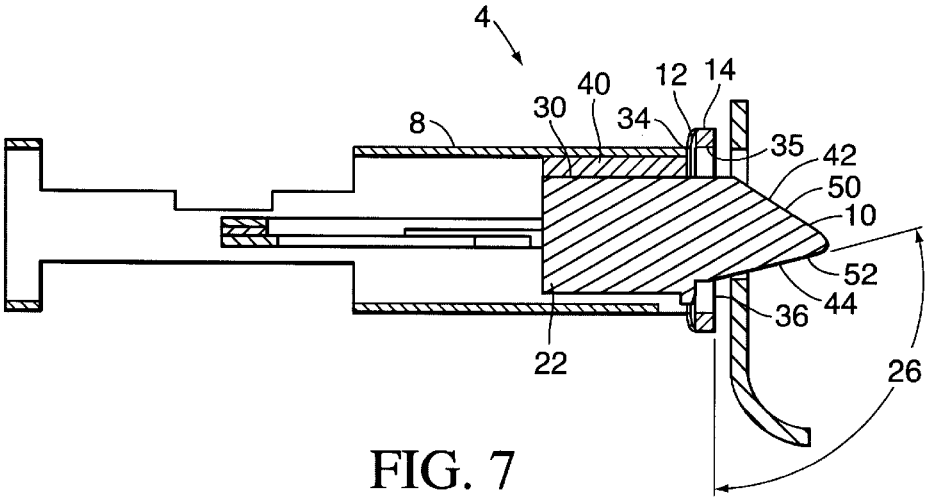

FIG. 7. A top view of the elongated latchbolt with a separate bearing sleeve.

DETAILED DESCRIPTION OF INVENTION

Definitions

"Latchbolt" means a component of a lock having a beveled end which projects from the lock front in its extended position, but is capable of being retracted back into the lock case by end pressure or drawn back by action of the lock mechanism. When the door is closed, the latchbolt projects into a hole provided in the strike, thus holding the door in a closed position.

"Bored-in latch assembly" means an assembly which is mounted in a prescribed cut-out (ANSI A115.W2) into a door.

"Exit Device" means a mechanism on a push side of a door that contains a touch bar activator. When this activator is depressed, it interacts with the latch tube mechanism so as to retract the latchbolt.

"Latch Tube" means a tubular housing that is attached to the face plate and scalp and contains the latch bolt and a retracting mechanism.

"Strike" means a rectangular shaped piece of metal which is mounted in a door frame on the same vertical center line as that of the lock front. Its function is to provide firm anchorage in the frame for the latchbolt.

"Scalp" means the rectangular finishing plate that covers the face plate through which the latchbolt passes.

"Face Plate" means a sub-plate at a latch end of a latch tube, usually attached to the latch tube and adjacent to the scalp. It also serves to anchor the latch tube to the door by means of screws placed through holes at each end, fastening into the edge of the door.

"Leading edge of the scalp" means the edge of the scalp that is adjacent to the face plate.

"Bearing Surface" means surface against which the latchbolt travels which prevents the edges of the face plate and scalp from biting or gouging into the latchbolt.

"Free of any edges" means that no edges of the face place or the leading edge of the scalp come into contact with the latch bolt.

"Bearing Surface Structure" means a structure which includes a roller bearing or a separate bearing sleeve that is placed between the latchbolt and latch tube on the pressure side of the latchbolt that prevents the edges of the face plate and the scalp from biting or gouging into the latchbolt.

"Separate Bearing Sleeve" means a sleeve that provides a bearing surface.

"Roller Bearing" means bearings that provide a bearing surface.

"Door Swing Side" means the pull side of the door which is the reverse bevel side of the latchbolt.

"Load reduction angle" means the angle on the door swing side of the latch bolt as measured from the end of the latch tube.

"Pressure Side" means side against which pressure is being exerted.

"Means for aiding the touch bar activator in retracting the latchbolt when a force is applied" includes the following structure and equivalents thereof:

1) a bearing surface structure 40 that is located on the same side as a latchbolt first bevel side 42;
2) a latchbolt second bevel side 44 that is on the substantially opposite side of the latchbolt first bevel side 42; and
3) a solid tail portion 22 of the latchbolt that remains in the latch tube when the latchbolt is in an extended position, the solid tail portion 22 is at least as long as the diameter of the latchbolt.

"A first bevel means for automatically retracting the latchbolt" includes the structure identified in the drawings as 50 and equivalents thereof. Reference No. 50 and reference No. 42 point to the same structure but the number 50 is being used for clarity.

"a second bevel means for:

(i) reducing a load on the latchbolt by aiding the touch bar activator in retracting the latchbolt from the strike when used in a door when force is applied to the door in a closed position, thereby allowing the door to move to an open position when force is applied to the door and the touch bar activator is depressed; and (ii) keeping the latchbolt in the strike when the touch bar activator is not depressed, thereby when in use on a door keeping the door in a closed position when force is applied to the door and the touch bar activator is not depressed"

includes the structure identified in the drawings as 52 and equivalents thereof. Reference No. 52 and reference No. 44 point to the same structure but the number 52 is being used for clarity.

Description

FIG. 1 shows a tubular exit device 2 with a latch tube assembly 4 installed in a door 6. A latch tube 8 contains a latchbolt 10. The latchbolt 10 extends through the latch tube 8, a face plate 12, and a scalp 14 on the door 6 and extends through a strike 16 mounted on the door frame (not shown) to keep the door 6 in a closed position. The latch tube 8 stops at the face plate 12. The latchbolt 10 retracts into the latch tube 8 when a touch bar 18 is depressed and this allows the door 6 to open. When lateral force is applied however the edges 34 and 35 of the scalp 14 and the face plate 12 bite into the latchbolt 10. This causes the latchbolt 10 to bind when retracting into the latch tube 8 and thus prevents the door 6 from opening.

FIG. 2. shows a tubular exit device 2 with a latch tube assembly 4 installed into a door 6. The latch tube 8 extends through the face plate 12 and the scalp 14 on the side of the door 6 with the touch bar 18. This creates a continuous bearing surface 20 that allows for smooth retraction of the latchbolt 10 when lateral pressure is applied against the push side 38 of the door 6. The extended latch tube 8 prevents the edges 34 and 35 of the scalp 14 and the face plate 12 from biting into the latchbolt 10 and thus the latchbolt 10 can be easily retracted.

FIG. 3. shows a top view of a latch assembly 4 a bearing surface 20. Because the latch tube 8 extends past the face plate 12 and past the scalp 14 on a pressure side 30 a bearing surface 20 is created for the latchbolt 10. The latch tube 8 prevents the edges 34 and 35 of the face plate 12 and the scalp 14 from coming into contact with the latchbolt 10.

FIG. 4. shows a top view of a latch assembly 4 with a latch tube 8 that stops before the face plate 12. A standard latchbolt 10 is shown with the door swing side 24 of the latchbolt 10 set at an angle 27 which is 90 degrees from the end 36 of the scalp 14. When a lateral force is applied the edges 34 and 35 of the face plate 12 and the scalp 14 bite into the latchbolt 10 making it difficult for the latchbolt to retract.

FIG. 5. shows a top view of a latch assembly 4 with a latch tube 8 that extends past the face plate 12 and the scalp 14. The latch tube 8 provides a bearing surface 20 for the latchbolt 10 which enables the latchbolt 10 to retract when lateral pressure is applied without the edges 34 and 35 of the face plate 12 and the scalp 14 coming into contact with the latchbolt 10. To aid in the smooth retraction of the latchbolt 10 the tail portion 22 is elongated and the swing side 24 of the latchbolt 10 is set at an angle 26 which is more than 90 degrees from an end 36 of the scalp 14.

FIG. 6. shows a top view of a latch assembly 4 with a latch tube 8 that stops before the face plate 12 and the scalp 14. A bearing surface structure 40 located between the latch tube 8 and the latchbolt 10 on the pressure side 30 of the latchbolt 10 enables the latchbolt 10 to retract when lateral pressure is applied without the edges 34 and 35 of the face plate 12 and the scalp 14 coming into contact with and gouging the latchbolt 10. To aid in the smooth retraction of the latchbolt 10 the tail portion 22 is elongated and the swing side 24 of the latchbolt 10 is set at an angle 26 which is more than 90 degrees from an end 36 of the scalp 14.

FIG. 7. shows a top view of a latch assembly 4 with a latch tube 8 that stops before the face plate 12 and the scalp 14. A bearing surface structure 40 located between the latch tube 8 and the latchbolt 10 on the pressure side 30 of the latchbolt 10 enables the latchbolt 10 to retract when lateral pressure is applied without the edges 34 and 35 of the face plate 12 and the scalp 14 coming into contact with and gouging the latchbolt 10. To aid in the smooth retraction of the latchbolt 10 the tail portion 22 is elongated and the swing side 24 of the latchbolt 10 is set at an angle 26 which is more than 90 degrees from an end 36 of the scalp 14.

I claim:

1. A bored-in latch assembly for a panic touch bar exit device having a latchbolt inserted within a latch tube, the latchbolt engaging a strike, a face plate integral to an end of the latch tube that is proximate to the strike, a scalp joined to the face plate, the latchbolt moves through the latch tube and enters the strike, a touch bar activator that is connected to the latchbolt and retracts the latchbolt from the strike the improvement comprising:

(a) a latchbolt having a first bevel means for automatically retracting the latchbolt, when in use the door having the latchbolt swings from an open position towards a closed position with respect to a frame having the strike so that the first bevel means contacts the strike;

(b) a second bevel means for:

(i) reducing a load on the latchbolt by aiding the touch bar activator in retracting the latchbolt from the strike when used in a door when force is applied to the door in a closed position, thereby allowing the door to move to an open position when force is applied to the door and the touch bar activator is depressed; and (ii) keeping the latchbolt in the strike when the touch bar activator is not depressed, thereby when in use on a door keeping the door in a closed position when force is applied to the door and the touch bar activator is not depressed, the second bevel means being on a substantially opposite side from said first bevel means; and (c) the latch tube having a bearing surface structure on the same side as the first bevel means which prevents any edge of the face plate and scalp from contacting the latchbolt on a latchbolt side which has the first bevel means.

2. A bored-in latch assembly as recited in claim 1 wherein the latchbolt has an integral tail portion that remains within the latch tube when the latchbolt is in an extended position, the integral tail portion having a linear length that is greater than the diameter of the latchbolt.

3. A bored in latch assembly as recited in claim 2 wherein the integral tail portion is solid.

4. A bored-in latch assembly as recited in claim 1 wherein the latchbolt has an integral solid tail portion that remains within the latch tube when the latchbolt is in an extended position.

5. A bored in latch assembly as recited in claim 1 wherein the bearing surface structure is a sleeve between the latch tube and latchbolt which supports the latchbolt within the latch tube.

6. A bored-in latch assembly as recited in claim 5 wherein the latchbolt has an integral tail portion that remains within the latch tube when the latchbolt is in an extended position, the integral tail portion having a linear length that is greater than the diameter of the latchbolt.

7. A bored in latch assembly as recited in claim 6 wherein the integral tail portion is solid.

8. A bored-in latch assembly as recited in claim 5 wherein the latchbolt has an integral solid tail portion that remains within the latch tube when the latchbolt is in an extended position.

9. A bored in latch assembly as recited in claim 1 wherein the bearing surface structure is a roller bearing between the latch tube and the latchbolt which supports the latchbolt within the latch tube.

10. A bored-in latch assembly as recited in claim 9 wherein the latchbolt has an integral tail portion that remains within the latch tube when the latchbolt is in an extended position, the integral tail portion having a linear length that is greater than the diameter of the latchbolt.

11. A bored in latch assembly as recited in claim 10 wherein the integral tail portion is solid.

12. A bored-in latch assembly as recited in claim 9 wherein the latchbolt has an integral solid tail portion that remains within the latch tube when the latchbolt is in an extended position.

13. A bored-in latch assembly as recited in claim 1 wherein the bearing surface structure is the latch tube.

14. A bored-in latch assembly as recited in claim 13 wherein the latchbolt has an integral tail portion that remains within the latch tube when the latchbolt is in an extended position, the integral tail portion having a linear length that is greater than the diameter of the latchbolt.

15. A bored in latch assembly as recited in claim 14 wherein the integral tail portion is solid.

16. A bored-in latch assembly as recited in claim 13 wherein the latchbolt has an integral solid tail portion that remains within the latch tube when the latchbolt is in an extended position.

17. A bored-in latch assembly for a panic touch bar exit device which is used on a door comprising:

(a) a latch tube;

(b) a latchbolt slideably within the latch tube, the latchbolt having a latchbolt first beveled side that extends from the latch tube when the latchbolt is in an extended position;

(c) a face plate integral to an end of the latch tube that is proximate to the latchbolt first beveled side;

(d) a scalp joined to the face plate;

(e) a strike having a hole to receive the latchbolt when in use;

(f) a touch bar activator that is connected to the latchbolt and moves the latchbolt from an extended position to a retracted position in which the latchbolt is within the latch tube (f) a means for aiding the touch bar activator in retracting the latchbolt when a force is applied.

18. A bored-in latch assembly for a panic touch bar exit device that is used on a door comprising:

(a) a solid latchbolt having a latchbolt first beveled side and a latchbolt second bevel side that is opposite the latchbolt first beveled side, the latchbolt also having a solid tail portion that is at least as long as the diameter of the latchbolt;

(b) a face plate integral to an end of the latch tube that is proximate to the latchbolt first beveled side;

(c) a scalp joined to the face plate;

(d) a latch tube that extends past an edge of the scalp and an edge of the face plate on the latchbolt first bevel side thereby preventing an edge of the scalp and an edge of the face plate from contacting the latchbolt on the latchbolt first bevel side, the latch tube slideably houses the latchbolt, the latchbolt first beveled side and the latchbolt second bevel side extend from the latch tube when the latchbolt is in an extended position, the solid tail portion always remains within the latch tube;

(e) a strike having a hole to receive the latchbolt when in use; and (f) a touch bar activator that is connected to the latchbolt and moves the latchbolt from an extended position to a retracted position in which the latchbolt is completely within the latch tube.

19. A bored-in latch assembly as recited in claim 18 wherein the angle of the latchbolt second bevel side as measured from an end of the latch tube is greater than 90 degrees.

20. A bored-in latch assembly as recited in claim 18 wherein the angle of the latchbolt second bevel side as measured from an end of the latch tube is greater than 90 degrees but less than 135 degrees.

* * * * *

UNITED STATES PATENT AND TRADEMARK OFFICE

CERTIFICATE OF CORRECTION

PATENT NO. : 6,746,060 B2
DATED : June 8, 2004
INVENTOR(S) : James A. O'Brien, II It is certified that error appears in the above-identified patent and that said Letters Patent is hereby corrected as shown below:

Column 1,
Line 57, cancel beginning with "face place," insert the following -- face plate, --
Line 66, cancel beginning with "bored in" insert the following -- bored-in --

Column 2,
Line 42, cancel beginning with "is mounted" insert the following -- is to be mounted --
Line 43, cancel beginning with "mounted in" insert the following -- mounted into --
Line 43, cancel beginning with "cut-out into a" insert the following -- cut-out in a --
Line 50, cancel beginning with "latch bolt" insert the following -- latchbolt --

Column 3,
Line 1, cancel beginning with "face place" insert the following -- face plate --
Lines 3 and 16, cancel beginning with "latch bolt" insert the following -- latchbolt --

Column 5,
Lines 29, 35, 44, 50 and 59, cancel beginning with "bored in" insert the following -- bored-in --

Column 6,
Line 6, cancel beginning with "bored in" insert the following -- bored-in --

Signed and Sealed this

Eleventh Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,746,060 B2
APPLICATION NO. : 09/841281
DATED : June 8, 2004
INVENTOR(S) : James A. O'Brien, II It is certified that error appears in the above-identified patent and that said Letters Patent is hereby corrected as shown below:

Title page, Item [73] Assignee name cancel "Ervos, Inc." and insert --Alfred L. Langtry--

Signed and Sealed this

Twenty-eighth Day of October, 2008

JON W. DUDAS
*Director of the United States Patent and Trademark Office*